United States Patent [19]

Grychtol et al.

[11] Patent Number: 4,979,962

[45] Date of Patent: Dec. 25, 1990

[54] DYEING OF NATURAL OR SYNTHETIC POLYAMIDES

[75] Inventors: Klaus Grychtol, Bad Durkheim; Manfred Daubitz, Ludwigshafen, both of Fed. Rep. of Germany

[73] Assignee: BASF Aktiengesellschaft, Ludwigshafen, Fed. Rep. of Germany

[21] Appl. No.: 357,280

[22] Filed: May 26, 1989

[30] Foreign Application Priority Data

May 28, 1988 [DE] Fed. Rep. of Germany ..... 3818182

[51] Int. Cl.[5] ..... D06P 3/32

[52] U.S. Cl. ..... 8/436; 8/404

[58] Field of Search ..... 8/404, 436

[56] References Cited

PUBLICATIONS

H. Zollinger, Color Chemistry, p. 122 (1987), Verlag Chemie, Weinheim.

Fortschr. Chem. Forsch. 7 (1966/67) p. 684.

Ullmanns Enzylklopadie der Technischen Chemie, vol. 16, p. 565, 4th Edition, 1978.

J. Soc. Dyers Colour. 104 (1988), No. 12.

*Primary Examiner*—Paul Lieberman

*Assistant Examiner*—John F. McNally

*Attorney, Agent, or Firm*—Oblon, Spivak, McClelland, Maier & Neustadt

[57] ABSTRACT

Natural and synthetic polyamides are dyed with the betaines of 1:1 chromium complexes of sulfo-containing azo or azomethine dyes from an aqueous liquor.

5 Claims, No Drawings

DYEING OF NATURAL OR SYNTHETIC POLYAMIDES

The present invention relates to a novel process for dyeing natural or synthetic polyamides with 1:1 chromium complexes of sulfo-containing azo or azomethine dyes in the form of their betaines.

The dyeing of wool with 1:1 chromium complex dyes on the azo or azomethine basis is common knowledge. The wool is treated with the dyes, which are customarily present in the form of their sodium salts, in a strongly acid medium. The pH of the aqueous dyeing liquor is in general round about 2.

However, under these dyeing conditions the wool suffers irreparable damage. On the other hand, these conditions must be maintained because otherwise the dyeings obtained are not sufficiently level (J. Soc. Dyers Colour. 104 (1988), 12, and H. Zollinger, Color Chemistry, page 122, 1987, Verlag Chemie, Weinheim).

It is an object of the present invention to provide a process whereby the material to be dyed is kept substantially intact but at the same time the dye turns out to be sufficiently level.

We have found that this object is achieved in an advantageous manner by dyeing natural or synthetic polyamides with 1:1 chromium complexes of sulfo-containing azo or azomethine dyes in an aqueous liquor if the choromium complexes of the dyes are used in the form of their betaines.

This is surprising since the betaines of 1:1 chromium complex dyes were hitherto considered of no utility, in particular as regards textile applications (Fortschr. Chem. Forsch. 7 (1966/67), 684).

The process according to the invention can be carried out with the betaines of virtually all 1:1 chromium complexes of sulfo-containing azo or azomethine dyes. Preference is given to the use of betaines containing one or two sulfo groups.

The preparation of betaines of such 1:1 chromium complexe dyes is known and described for example in Ullmanns Enz-vklopädie der technischen Chemie, volume 16, page 565, 4th edition, 1978.

The methods mentioned therein can be used to prepare essentially all betaines of the chromium complex dyes mentioned.

Suitable azo or azomethine dyes from which to form the 1:1 chromium complexes are composed for example of hydroxyl-containing aniline or aminonaphthalene derivatives, which may be substituted by halogen, $C_1$–$C_4$-alkyl, $C_1$–$C_4$-alkoxy, nitro, carboxyl, sulfamoyl or $C_1$–$C_4$monoalkyl- or -dialkyl-sulfamoyl, as diazo or amino component.

Examples of coupling components are hydroxyl and/or amino-containing benzene, naphthalene or quinoline derivatives, which may be substituted by halogen, $C_1$–$C_4$-alkyl, $C_1$–$C_{14}$-alkoxy, nitro, carboxyl, sulfamoyl or $C_1$–$C_4$-monoalkyl- or -dialkyl-sulfamoyl, unsubstituted or $C_1$–$C_4$-alkyl-, $C_1$–$C_{14}$-alkoxy-, nitro- or halogen-substituted 1-phenyl-3-methylpyrazol-5-one, acetoacetamide or unsubstituted or $C_1$–$C_{14}$-alkyl-, $C_1$–$C_4$-alkoxy-, nitro- or halogen-substituted acetoacetanilide.

The aldehyde components are for example hydroxyl-containing benzaldehyde or naphthaldehyde derivatives, which may be substituted by halogen, $C_1$–$C_{14}$-alkyl, $C_1$–$C_4$-alkoxy or nitro, or unsubstituted or $C_1$–$C_{14}$-alkyl-, $C_1$–$C_4$-alkoxy-, nitro- or halogen-substituted 1-phenyl-3-methyl-4-formylpyrazol-5-one.

It will be readily understood that here in the case of the azo dyes the diazo component or the coupling component must have at least one sulfo group. In the case of the azomethine dyes, the amino component or the aldehyde component must contain at least one sulfo group.

Important 1:1 chromium complex dyes of sulfo-containing azo or azomethine dyes which can be used in the novel process in the form of betaines are for example C.I. Acid Yellow 99, C.I. Acid Yellow 104, C.I. Acid Yellow 176, C.I. Acid Orange 72, C.I. Acid Orange 74, C.I. Acid Red 179, C.I. Acid Red 183, C.I. Acid Red 186, C.I. Acid Red 214, C.I. Acid Violet 58, C.I. Acid Blue 156, C.I. Acid Blue 158, C.I. Acid Blue 161, C.I. Acid Green 12, C.I. Acid Green 35 and C.I. Acid Black 54.

Natural polyamides which can be dyed by means of the process according to the invention are for example leather and textile fiber material. Textile fiber material is in particular wool. But it is also possible to dye mixtures of wool/polyamide, wool/polyester, wool/cellulose or wool/polyacrylonitrile or silk. This fiber material may be present in a wide range of forms, for example as loose material, tops, yarn, piece goods or carpet.

The synthetic polyamide fiber material which is dyeable according to the invention comprises any known synthetic polyamide suitable for the purpose. This fiber material can likewise be present in a wide range of forms, for example as loose material, slubbing, yarn, piece goods or carpet.

The dyeing of wool or leather by means of the novel process is preferred.

The process according to the invention is advantageously carried out by adding the betaine, for example in solid form or in the form of an aqueous suspension, to the dyeing liquor. Based on the weight of the dyeing liquor, the proportion of chromium complex dye is for example from 0.0004 to 0.5%, preferably from 0.001 to 0.15%.

The liquor pH should in general be from 3 to 7, preferably from 3 to 6, in particular from 3.5 to 5. This pH is adjusted by the addition of appropriate amounts of inorganic or organic acids. Suitable acids are for example sulfuric acid, formic acid and acetic acid. The use of formic acid is preferred.

The dyeing liquor may further contain assistants and additives which are customary and known in the art, for example defoamers, wetting agents or crease resist agents.

The material to be dyed is then introduced into the dyeing liquor, for example in an amount of from 2 to 20%, preferably from 5 to 10%, based on the weight of the dyeing liquor, and dyed at from 80 to 100° C. After the dyeing has ended, which will in general take from 1 to 3 hours, the dyed material is removed from the dyebath, rinsed and dried.

An advantage of the process according to the invention is that dyeing wool under the conditions of the invention causes little damage to the wool, if any, since the wool is being treated close to its isoelectric point. A further advantage is that the actual dyeing process, in contradistinction from the existing processes, need not be preceded by dissolution of the sodium salts of the 1:1 chromium complex dyes in water. This step is in general time-consuming. In addition, it frequently leads to clumping of the dye, which can cause unlevel dyeings.

Finally, since it is possible to dye at a higher pH, significantly less acid need be added to the dyeing liquor.

It is surprising that dyeings of high levelness are obtained on natural and synthetic polyamides. This was not foreseeable, given the low water solubility of the betaines. A further surprise is that the novel dyeing process gives a significantly better bath exhaustion, leaving much less dye in the dyeing liquor at the end of the dyeing than conventional processes.

The Examples illustrate the invention in more detail.

EXAMPLE 1

Preparation of the betaine of C.I. Acid Blue 161 (C.I. No. 15,706)

3,000 ml of water and 120 g of sodium hydroxide were heated to 60° C. 320 g of 2-naphthol were added and dissolved. 90 g of ammonium sulfate were then added. This was followed at 60° C. and pH 11 by the addition of 500 g of 1-diazonaphth-2-ol-4-sulfonic acid in the course of 45 minutes. A total of 100 g of sodium hydroxide were added to maintain the pH at 10.5–11, and the coupling had ended in the course of 30 minutes. 500 ml of half-diluted hydrochloric acid were added to bring the pH to 1.0. A chromium formate solution (containing 100 g of chromium) was then added. This was followed by stirring at 130° C. in a pressure apparatus for from four to five hours. Cooling down was followed by filtration under suction and drying.

EXAMPLE 2

Dyeing Method (Wool)

To an aqueous dyeing liquor containing 2% by weight of an assistant based on an ethoxylated oleylamine, 5% by weight of sodium sulfate.10 $H_2O$ and 5% by weight of formic acid (85% strength by weight) was added 0.6% by weight of the betaine of C.I. Acid Blue 161 (C.I. No. 15,706); cf. Example 1. Wool fabric was treated in this dyeing liquor at from 98° to 100° C. for 1 hour. The liquor pH was 3.2. The fabric was then removed from the liquor, rinsed and dried. The dyeing was level.

EXAMPLE 3

Dyeing Method (Wool)

Wool fabric was dyed by the method of Example 2. The dye used was 0.35% by weight of the betaine of C.I. Acid Red 183 (C.I. No. 18,800). Again a level dyeing was obtained.

EXAMPLE 4

Dyeing Method (Glove Leather)

Pretreatment

Glove leather was conventionally tanned, fat-liquored and dried.

Dyeing stage

In what follows, all the on the dry weight of glove leather.

Glove leather was treated at 50° C. in 100% of an aqueous liquor containing 2% of ammonia and 1% of a wetting agent based on an addition product of ethylene oxide on oleylamine for 120 minutes. This liquor was then dropped, and the glove leather to be dyed was removed from the dyeing vessel. The dyeing vessel was then charged with 600% of an aqueous liquor and 4% of the betaine of C.I. Acid Blue 161 (C.I. No. 15,706). The glove leather was reintroduced into the dyeing vessel and drummed for 60 minutes. Drumming was continued for a further 30 minutes following addition of 4% formic acid (85% strength by weight) in 2 portions 15 minutes apart. The dyeing liquor was then dropped, and the leather was rinsed. It was then worked up in a conventional manner, i.e. set out, dried, moistened and staked.

EXAMPLE 5

Dyeing Method (Upper Leather)

Pretreatment

Upper leather was conventionally retanned and washed.

Dyeing Stage

In what follows, all the percentages are based on the dry weight of upper leather.

A liquor of 200% of water at 30° C. was introduced first. 2% of the betaine of C.I. Acid Blue 161 (C.I. No. 15,706) were added. The leather was drummed in this liquor for 60 minutes. Following addition of 4% of a commercial fat liquor the drumming was continued for a further 60 minutes, 1% of formic acid (85% strength by weight) was then added, and the leather was drummed for another 30 minutes. The dyeing liquor was then dropped and the leather was rinsed.

The leather was worked up in a conventional manner, i.e. set out, dried, moistened and staked.

EXAMPLE 6

Glove leather was dyed by the method of Example 4. The dye used was 4% of the betaine of C.I. Acid Red 183 (C.I. No. 18,800).

EXAMPLE 7

Upper leather was dyed by the method of Example 5. The dye used was 2% of the betaine of C.I. Acid Red 183 (C.I. No. 18,800).

The dyes listed in the table below can be converted by the method of Example 1 into the betaines of their 1:1 chromium complexes and be used for a dyeing as described in Examples 2 to 7.

| Example No. | Dye | Hue on wool or leather |
|---|---|---|
| 8 | 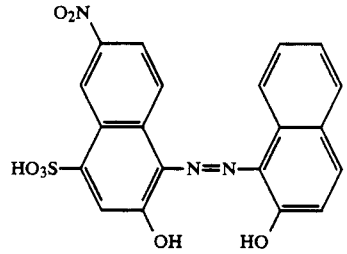 | black |

-continued
| Example No. | Dye | Hue on wool or leather |
|---|---|---|
| 9 | 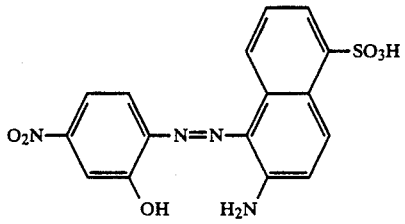 | green |
| 10 | 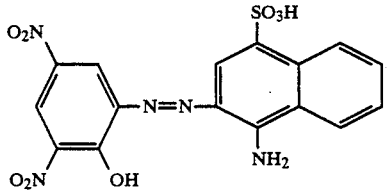 | green |
| 11 | 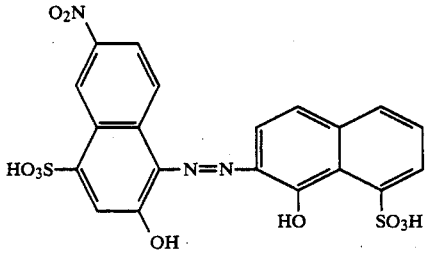 | black |
| 12 | 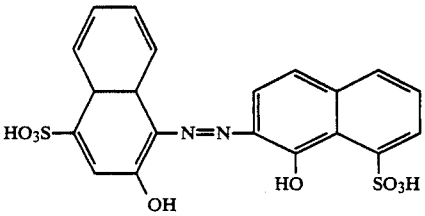 | blue |
| 13 | 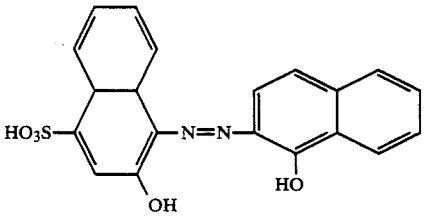 | blue |
| 14 | 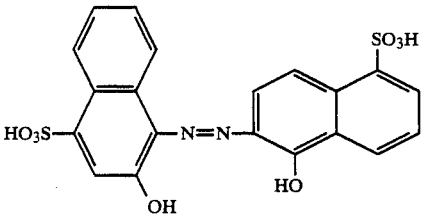 | blue |
| 15 | 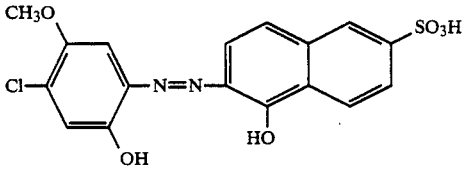 | blue |

-continued
| Example No. | Dye | Hue on wool or leather |
|---|---|---|
| 16 | 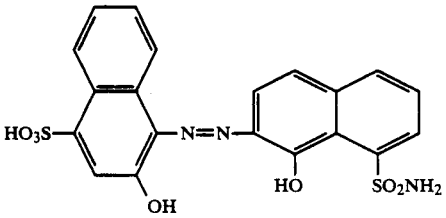 | blue |
| 17 | 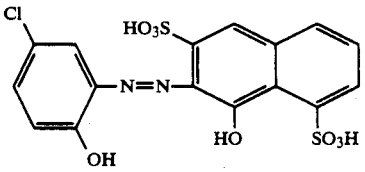 | blue |
| 18 | 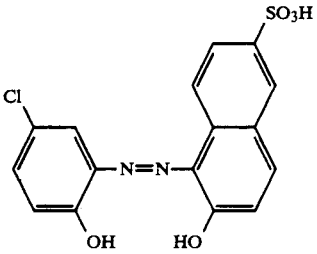 | violet |
| 19 | 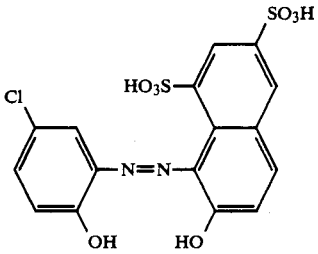 | violet |
| 20 | 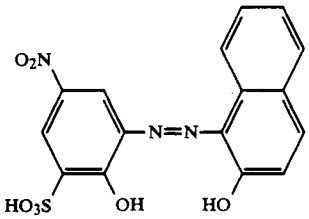 | brown |
| 21 | 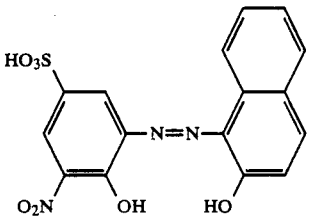 | brownish black |
| 22 | 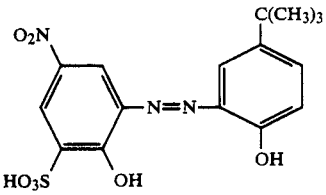 | brown |

-continued
| Example No. | Dye | Hue on wool or leather |
|---|---|---|
| 23 | 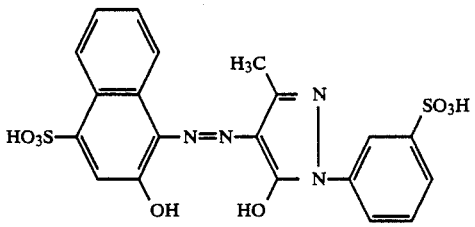 | pink |
| 24 | 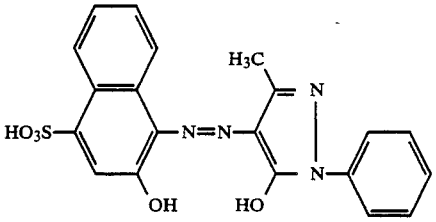 | pink |
| 25 | 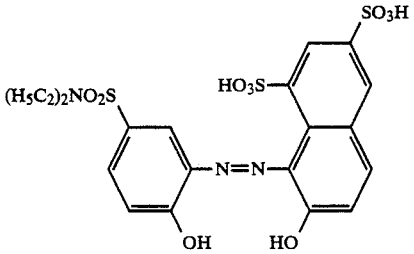 | dull bluish red |
| 26 | 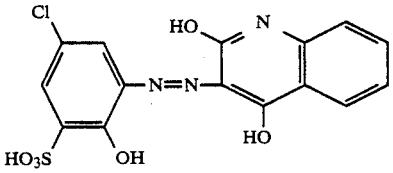 | red |
| 27 | 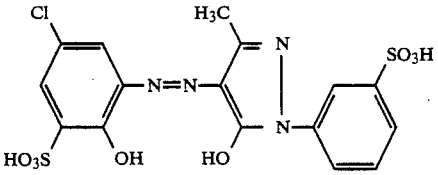 | red |
| 28 | 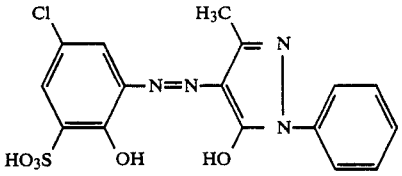 | red |
| 29 | 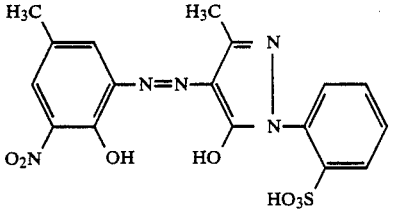 | red |

-continued
| Example No. | Dye | Hue on wool or leather |
|---|---|---|
| 30 | 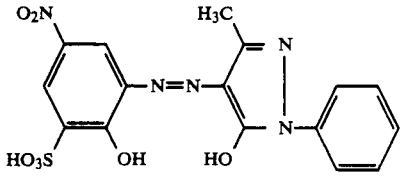 | orange |
| 31 | 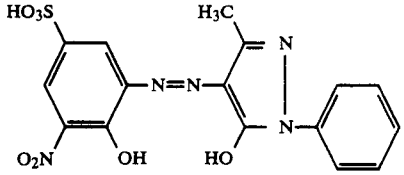 | orange |
| 32 | 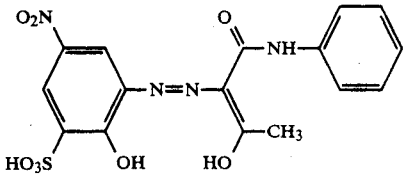 | yellow |
| 33 | 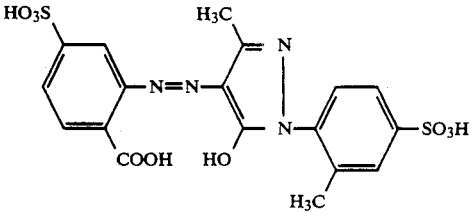 | yellow |
| 34 | 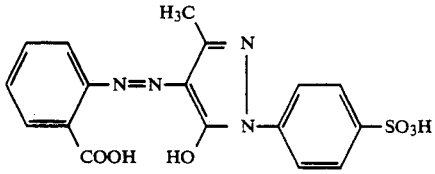 | yellow |
| 35 | 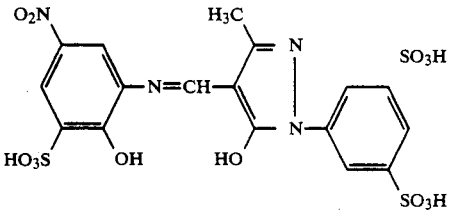 | yellow |
| 36 | 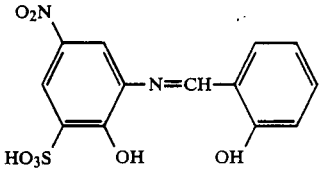 | yellow |
| 37 | 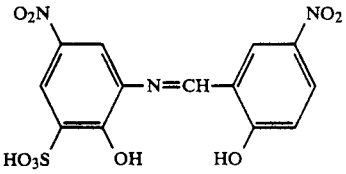 | yellow |
We claim:
1. A process for dyeing a natural or synthetic polyamide with a 1:1 chromium complex of a sulfo-containing azo or azomethine dye in an aqueous liquor, which comprises using the chromium complex of the dye in the form of its betaine.

2. A process as claimed in claim 1, wherein the polyamide is dyed at a pH of from 3 to 7.

3. A process as claimed in claim 1, wherein the natural polyamide used is wool.

4. A process as claimed in claim 1, wherein the natural polyamide used is leather.

5. The process of claim 1, wherein the sulfo-containing azo or azomethine dye is selected from the group consisting of C.I. Acid Yellow 99, C.I. Acid Yellow 104, C.I. Acid Yellow 176, C.I. Acid Orange 72, C.I. Acid Orange 74, C.I. Acid Red 179, C.I. Acid Red 183, C.I. Acid Red 186, C.I. Acid Red 214, C.I. Acid Violet 58, C.I. Acid Blue 156, C.I. Acid Blue 158, C.I. Acid Blue 161, C.I. Acid Green 12, C.I. Acid Green 35 and C.I. Acid Black 54.

* * * * *